US009630753B2

(12) United States Patent
Ziegenhorn et al.

(10) Patent No.: US 9,630,753 B2
(45) Date of Patent: Apr. 25, 2017

(54) CLOSURE

(71) Applicant: The Clorox Company, Oakland, CA (US)

(72) Inventors: David Ziegenhorn, Libertyville, IL (US); Jay Hinkle, Libertyville, IL (US); Greg Showers, Libertyville, IL (US); Kerry D. Azelton, Pleasanton, CA (US); Stacie M. Alvarez, Pleasanton, CA (US); Bryan Irwin, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 194 days.

(21) Appl. No.: 14/477,332

(22) Filed: Sep. 4, 2014

(65) Prior Publication Data

US 2014/0367352 A1 Dec. 18, 2014

Related U.S. Application Data

(63) Continuation of application No. 13/689,960, filed on Nov. 30, 2012, which is a continuation-in-part of (Continued)

(30) Foreign Application Priority Data

May 10, 2011 (GB) ..... 1107758.3
May 10, 2011 (GB) ..... 1107760.9

(51) Int. Cl.
*B65D 49/12* (2006.01)
*B65D 41/32* (2006.01)
(Continued)

(52) U.S. Cl.
CPC ..... *B65D 49/12* (2013.01); *B65D 41/32* (2013.01); *B65D 43/0235* (2013.01); *B65D 47/0838* (2013.01); *B65D 2101/003* (2013.01)

(58) Field of Classification Search
CPC ..... B65D 49/12; B65D 41/12
(Continued)

(56) References Cited

U.S. PATENT DOCUMENTS 3,795,338 A 3/1974 Swartzbaugh et al.
4,487,324 A * 12/1984 Ostrowsky ..... B65D 47/0814 215/225

(Continued)

FOREIGN PATENT DOCUMENTS

EP 1503942 B 5/2006
EP 2144821 12/2011

(Continued)

*Primary Examiner* — Anthony Stashick
*Assistant Examiner* — Raven Collins
(74) *Attorney, Agent, or Firm* — Ann Lee

(57) ABSTRACT

Described is a closure adapted to be fit on top of containers such as bottles. In various embodiments, the closure may include an outer skirt and an inner skirt. The closure may be engageable with a container neck. In some embodiments, a region of weakness may be adapted to break and/or deform upon an attempt to remove the closure from the container neck. In some embodiments, after the break and/or deformation, the closure may no longer be engageable with the container neck.

4 Claims, 11 Drawing Sheets

Related U.S. Application Data application No. 13/467,961, filed on May 9, 2012, now abandoned.

(60) Provisional application No. 61/724,773, filed on Nov. 9, 2012, provisional application No. 61/565,877, filed on Dec. 1, 2011.

(51) Int. Cl.
*B65D 47/08* (2006.01)
*B65D 43/02* (2006.01)

(58) Field of Classification Search
USPC ..... 215/253, 235, 237, 255
See application file for complete search history.

(56) References Cited

U.S. PATENT DOCUMENTS

| | | | | |
|---|---|---|---|---|
| 4,598,833 | A | 7/1986 | Herr | |
| 4,726,483 | A | 2/1988 | Drozd | |
| 5,096,077 | A * | 3/1992 | Odet | B65D 47/0838 215/211 |
| 5,411,157 | A | 5/1995 | King et al. | |
| 5,547,091 | A | 8/1996 | Neveras et al. | |
| 5,749,484 | A | 5/1998 | Trout | |
| 6,766,926 | B1 | 7/2004 | Elchert | |
| 2005/0279727 | A1 | 12/2005 | Grasswald et al. | |
| 2007/0102389 | A1 | 5/2007 | Hoepner et al. | |
| 2007/0144996 | A1 | 6/2007 | Sawyer | |
| 2008/0314860 | A1 * | 12/2008 | Pugne | B65D 55/022 215/330 |
| 2009/0107948 | A1 | 4/2009 | Brand et al. | |
| 2010/0282705 | A1 | 11/2010 | Ledemeney | |

FOREIGN PATENT DOCUMENTS

| | | |
|---|---|---|
| JP | 11011508 | 1/1990 |
| WO | WO0130663 | 5/2001 |
| WO | WO2008139196 | 11/2008 |
| WO | WO2009002717 | 12/2008 |
| WO | WO2009055409 | 4/2009 |

* cited by examiner

CLOSURE

CROSS REFERENCE TO RELATED APPLICATIONS

This application is a continuation application and claims priority to co-pending U.S. patent application Ser. No. 13/689,960 entitled "Closure", filed Nov. 30, 2012, which is a continuation in part of U.S. patent application Ser. No. 13/467,961 entitled "Closure", filed May 9, 2012, which claims benefit under 35 U.S.C. section 119 to United Kingdom Patent Application Nos. 1107760.9 and 11077758.3, both filed May 10, 2011. U.S. patent application Ser. No. 13/689,960 also claims the benefit of U.S. Provisional Patent Application Nos. 61/565,877 and 61/724,773, filed Dec. 1, 2011 and Nov. 9, 2012, respectively, both entitled "Closure." All of these disclosures are incorporated herein by reference in their entirety for all purposes.

BACKGROUND

It is well known to provide mechanisms for indicating if a closure associated with a container has been opened at least once. These mechanisms may come in various forms, including, for example, tamper evident bands and tabs. However, there are situations in which what is of more concern is ensuring that the closure has not been completely removed so that an associated container can be filled, for example, with an inferior product.

SUMMARY

According to one aspect of the present disclosure there is provided a closure including a base that may be attached to a container. The base may include a top deck from which depends an outer and an inner skirt, the inner skirt being engageable with a container neck. The top deck may include a region of weakness between the inner and outer skirts that is deformed and/or broken if removal of the closure from a container is attempted. By providing a region of weakness in the top deck, if removal of the closure is attempted an irreversible change in the structure of the top deck may result so that the closure cannot be properly reapplied and resealed to a container.

According to another aspect of the present disclosure there is provided a closure for a container, the closure having a base with an outer skirt and an inner skirt. The inner skirt may be engagable with a container neck and may include one or more regions of weakness arranged to break and/or deform if an attempt is made to remove the closure from the container neck following first application, in order to prevent reapplication.

One or more aspects of the present disclosure may be present in the same closure. According to a further aspect of the present disclosure there is provided a closure as described herein in combination with a container.

BRIEF DESCRIPTION OF THE DRAWINGS

Subject matter is particularly pointed out and distinctly claimed in the concluding portion of the specification. The foregoing and other features of the present invention will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION

Figure 1:
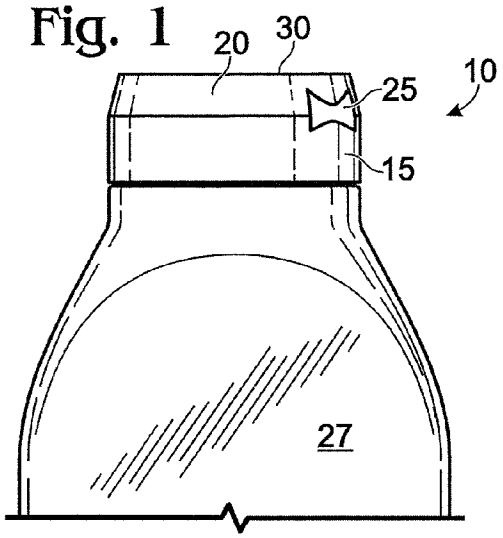
FIG. 1 is a partial view of a bottle fitted with a closure formed according to various embodiments.
Figure 2:
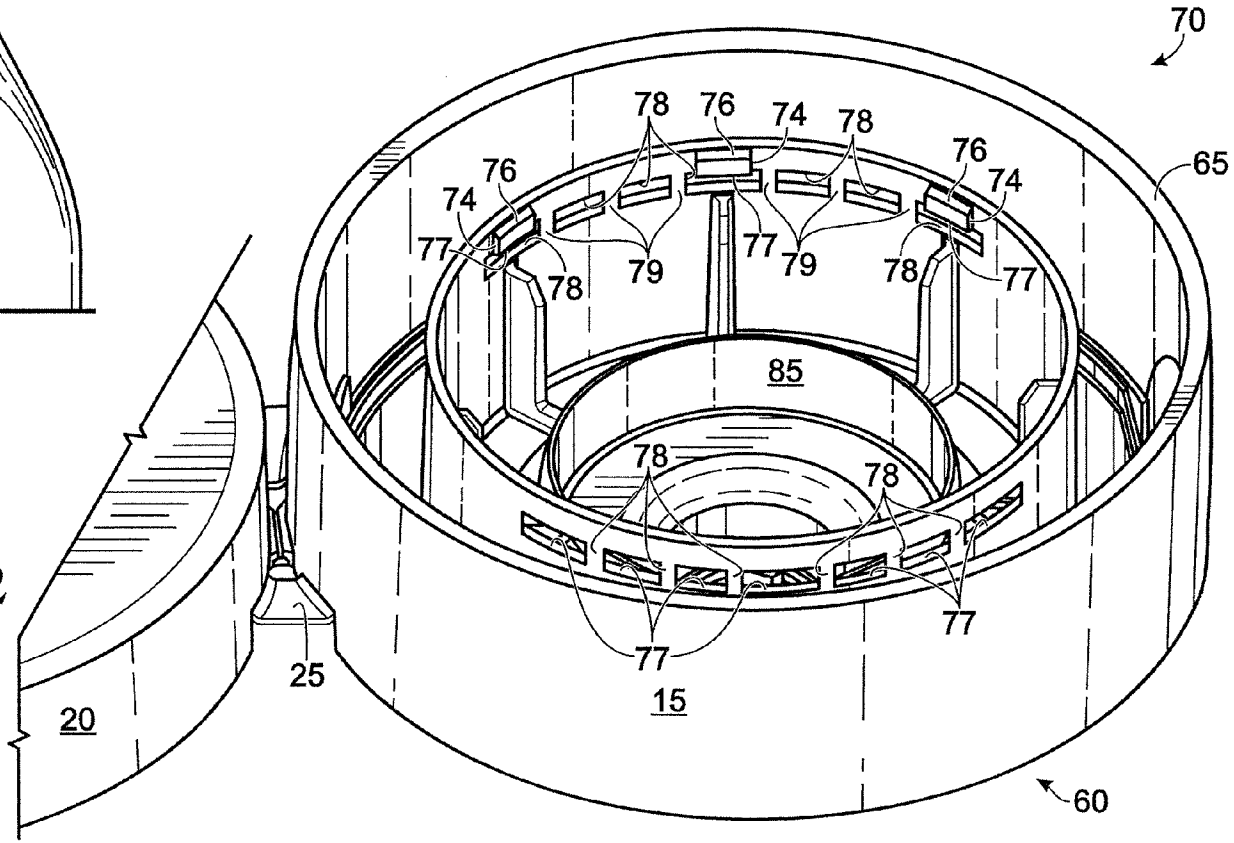
FIG. 2 is a cross-sectional view of an underside of a closure, in accordance with various embodiments.

Reference will now be made to the drawings wherein like numerals refer to like parts throughout. For ease of description, the components of embodiments of the present disclosure are described in the normal (upright) operating position, and terms such as upper, lower, horizontal, etc., are used with reference to this position. It will be understood, however, that the components of embodiments of the present disclosure may be manufactured, stored, transported, used, and sold in an orientation other than the position described.

Figures illustrating the components of embodiments of the present disclosure show some conventional mechanical elements that may be known and that may be recognized by one skilled in the art. The detailed descriptions of such elements that are not necessary to an understanding of the disclosure, and accordingly are herein presented only to the degree necessary to facilitate an understanding of the novel features of the present disclosure.

As used herein and in the appended claims, the term "comprising" is inclusive or open-ended and does not exclude additional unrecited elements, compositional components, or method steps. Accordingly, the term "comprising" encompasses the more restrictive terms "consisting essentially of" and "consisting of"

It must be noted that, as used in this specification and the appended claims, the singular forms "a," "an," and "the" include plural references unless the content clearly dictates otherwise. Similarly, the use of substantially any plural terms herein may be translated by those having skill in the art from the plural to the singular as is appropriate to the context and/or application. The various singular/plural permutations may be expressly set forth herein for sake of clarity.

In those instances where a convention analogous to "at least one of A, B, and C, etc." is used, in general such a construction is intended in the sense one having skill in the art would understand the convention (e.g., "an apparatus having at least one of A, B, and C" would include but not be limited to apparatuses that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art, all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 elements refers to groups having 1, 2, or 3 elements. Similarly, a group having 1-5 elements refers to groups having 1, 2, 3, 4, or 5 elements, and so forth.

Unless defined otherwise, all technical and scientific terms used herein have the same meaning as commonly understood by one of ordinary skill in the art to which embodiments of the present invention pertain. Although a number of methods and materials similar or equivalent to those described herein can be used in the practice of the present invention, the preferred materials and methods are described herein.

Referring to FIG. 1, there is shown a closure generally indicated at 10. The closure 10 comprises a generally cylindrical body with a base 15 and a lid 20. The base 15 and lid 20 are connected to each other by a hinge 25. The closure 10 is affixed to a container 27, which may in some embodiments be a bottle.

Referring to FIGS. 2-6, the base 15 may include a generally circular-disc shape top deck 60 that may be gently convexly curved in some embodiments. An annular spout 90 may project from the center of the top deck 60 and may define a central dispensing orifice 91 (See FIG. 3). A generally cylindrical outer skirt 65 depends from the periphery of the deck 60. A cylindrical inner skirt 70 depends from the deck 60 radially inwardly of the outer skirt 65. A sealing spigot 85 depends from the deck radially inwardly of the inner skirt 70.

The inner skirt 70 may be engageable with a container neck 28 (see FIGS. 3-6). At the open end of the inner skirt 70, one or more snap members 74 are positioned. Each snap member 74 may include a ramped surface 76 at its bottom to allow a flange 29 of the container neck 28 to snap into the inner skirt 70 above the snap members 74. The surface of the snap members 74 opposite the ramp may be a flat abutment surface 77, which may abut the flange 29 to prevent the container neck 28 from being removed from inner skirt 70.

The inner skirt 70 may include a region of weakness adapted to break and/or deform upon an attempt to remove the closure 10 from the container neck 28, wherein after the break and/or deformation, the closure 10 is no longer engageable with the container neck 28. Regions of weakness having various configurations may be used.

Figure 3:
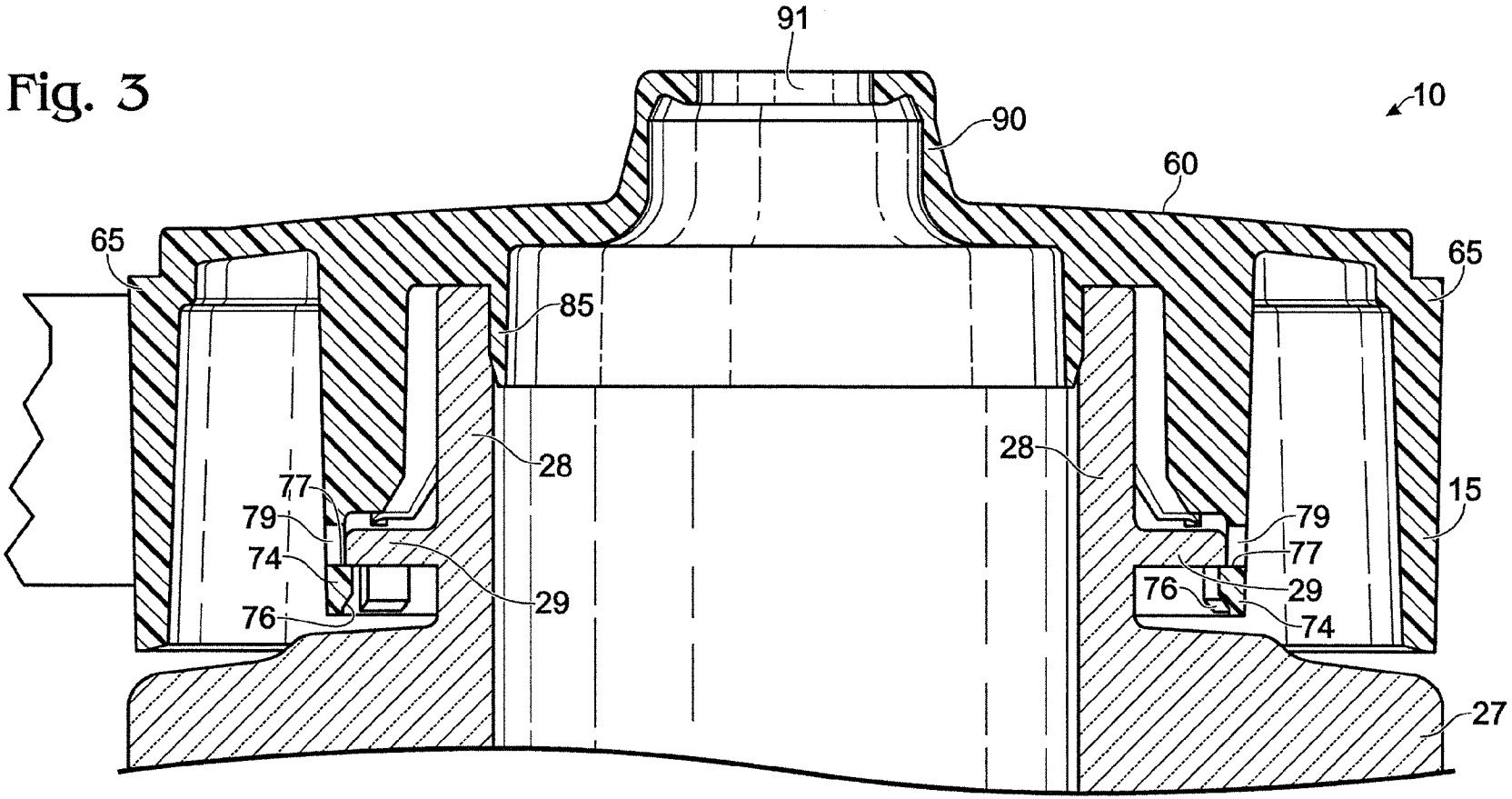
FIG. 3 is a cross-sectional partial view of the closure of FIG. 2, in accordance with various embodiments.
Figure 4:
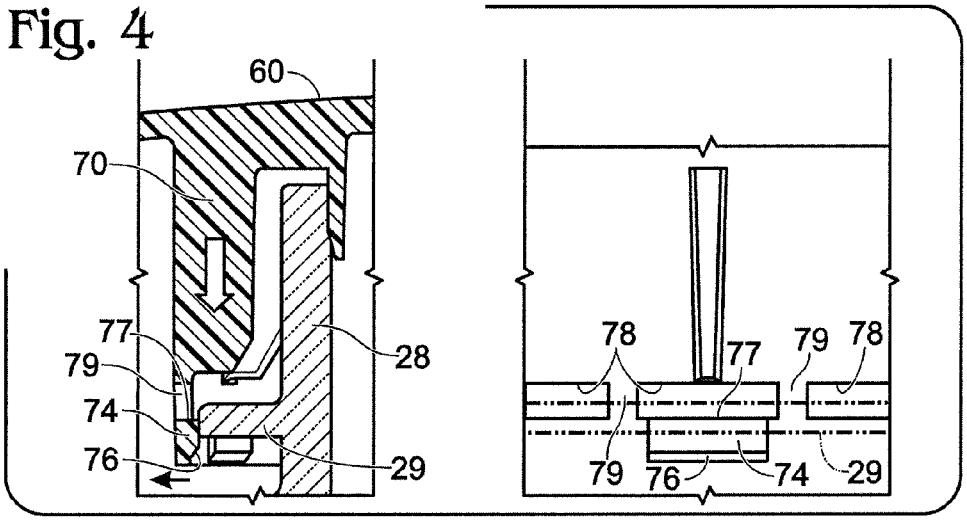
FIG. 4 is a cross-sectional partial view of the closure of FIGS. 2-3 being lowered onto a container neck, in accordance with various embodiments.
Figure 5:
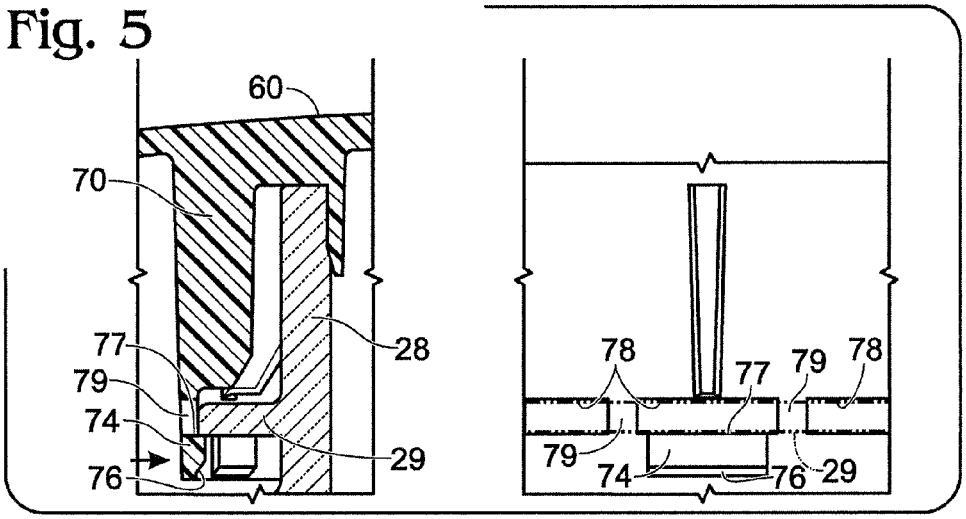
FIG. 5 is a cross-sectional partial view of the closure of FIGS. 2-4 as it may be engaged with a container neck, in accordance with various embodiments.

For example, in FIGS. 2-6, the inner skirt 70 includes a plurality of apertures 78 separating a plurality of frangible portions 79. The plurality of frangible portions 79 may be adjacent the snap members 74 so that once a container neck 28 is inserted past the snap members 74, the flange 29 is flush with the plurality of apertures 78 and frangible portions 79, as shown in FIGS. 3 and 5.

Figure 6:
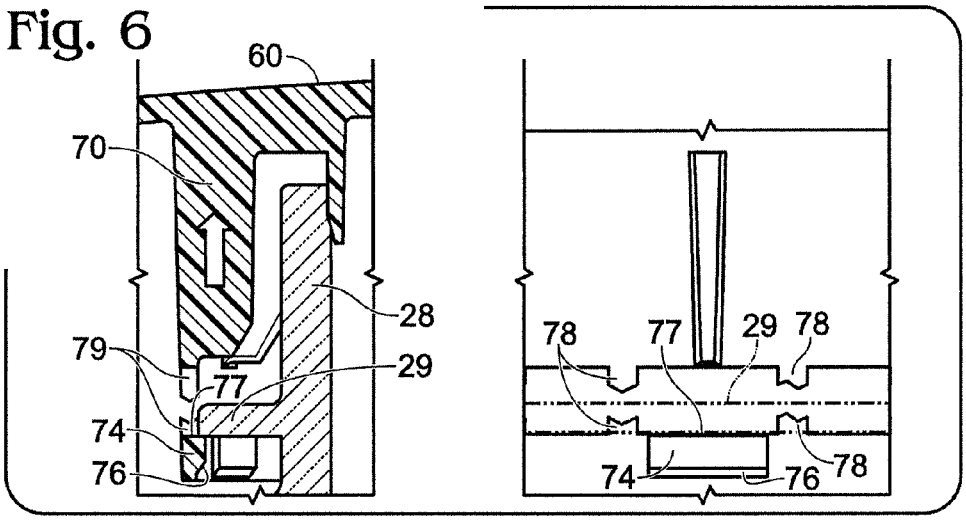
FIG. 6 is a cross-sectional partial view of the closure of FIGS. 2-5 being removed from the container neck, in accordance with various embodiments.
Figure 7:
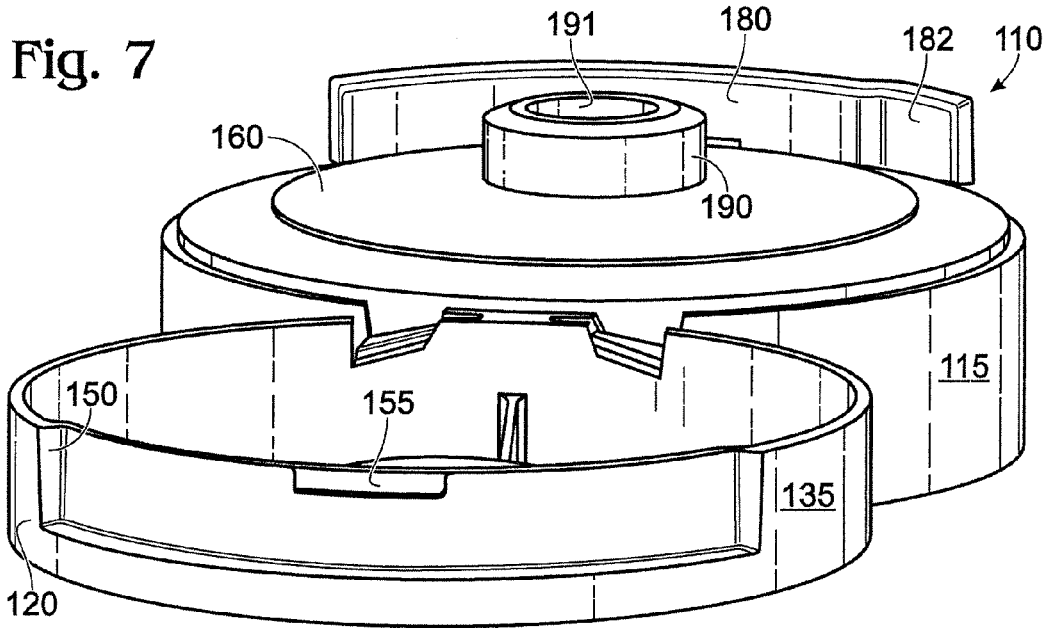
FIG. 7 is a top view of another closure, in accordance with various embodiments.

As shown in FIG. 6, if an attempt is made to forcefully remove the closure 10 from the container neck 28, the flange 29 pulls on the snap members 74, thereby causing the plurality of frangible portions 79 to break. In various embodiments, when all or most of the frangible portions 79 are broken, closure 10 may no longer be engageable with container neck 28. For example, in various embodiments, the snap members 74 may only be positioned on the inner skirt 70 adjacent the plurality of apertures 78 and frangible portions 79. In such cases, once the frangible portions 79 are broken, the snap members 74 may be only loosely connected to closure 10 and therefore may be unable to snap onto container neck 28.

Referring next to FIGS. 7 to 13, there is shown another embodiment of a closure generally indicated 110. The closure 110 comprises a generally cylindrical body with a base 115 and a lid 120. The base 115 and lid 120 are connected to each other by a hinge 125.

The lid 120 may include a circular, disc-shape top plate 130 and a generally cylindrical side wall 135 which depends from the periphery of the top plate 130. An annular spigot 140 depends from the centre of the plate and an annular sealing projection 145 also depends from the top plate 130 radially outwardly of the spigot 140. Opposite the hinge 125, the lid side wall 135 includes an arcuate recess 150. At the centre of the recess 150, a hook 155 projects from the open end of the side wall 135.

Figure 10:
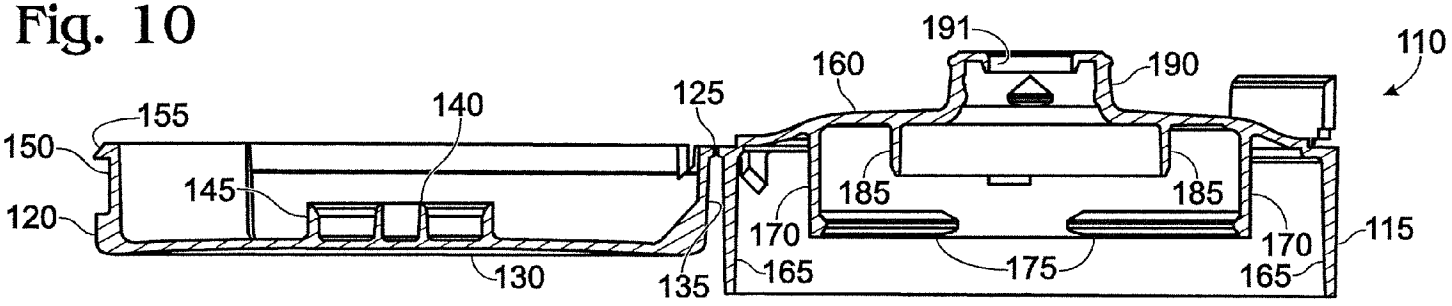
FIG. 10 is a cross-sectional side view of the closure shown in FIGS. 7-9, in accordance with various embodiments.
Figure 11:
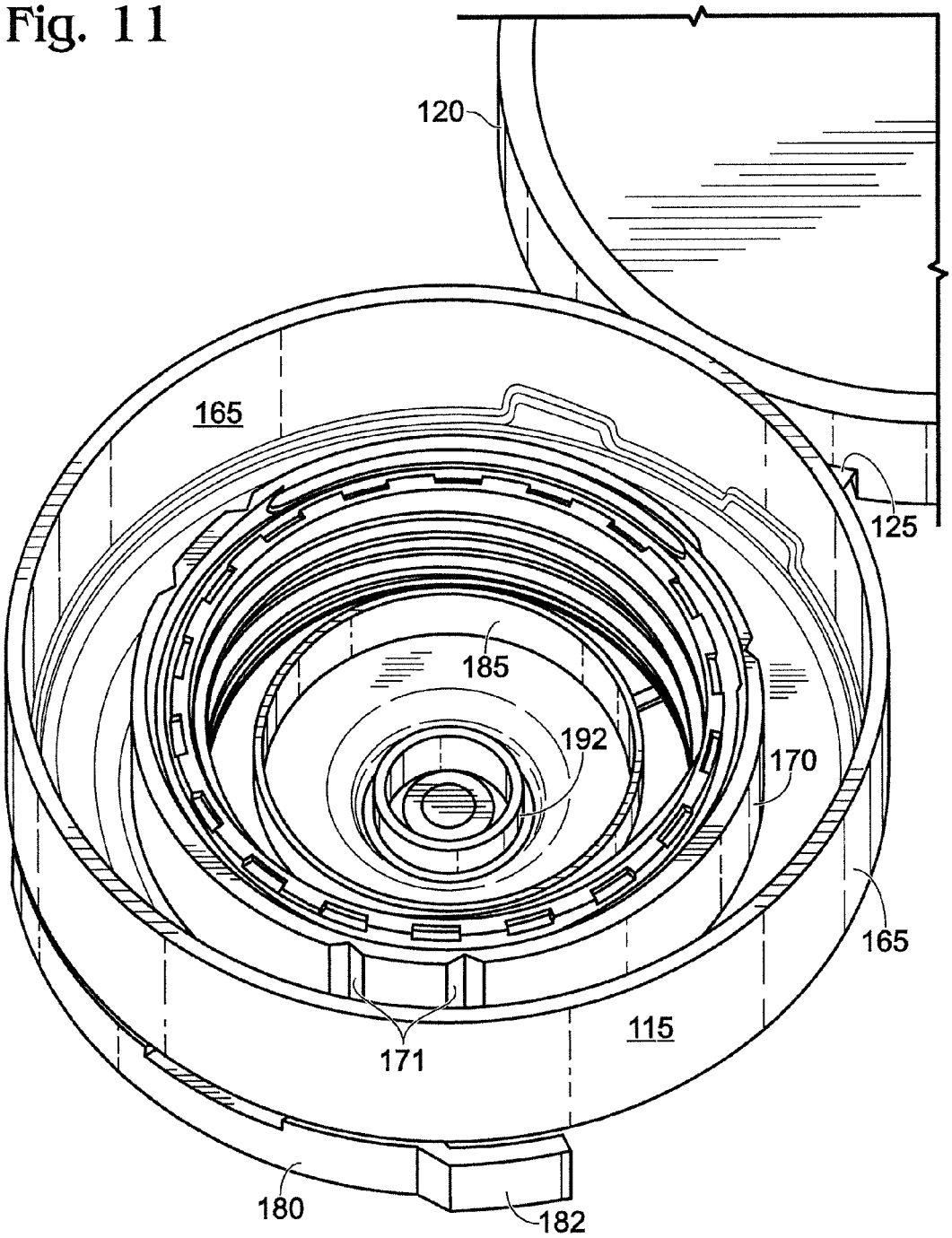
FIG. 11 is a partial view of the underside of the closure shown in FIGS. 7-10, in accordance with various embodiments.
Figure 12:
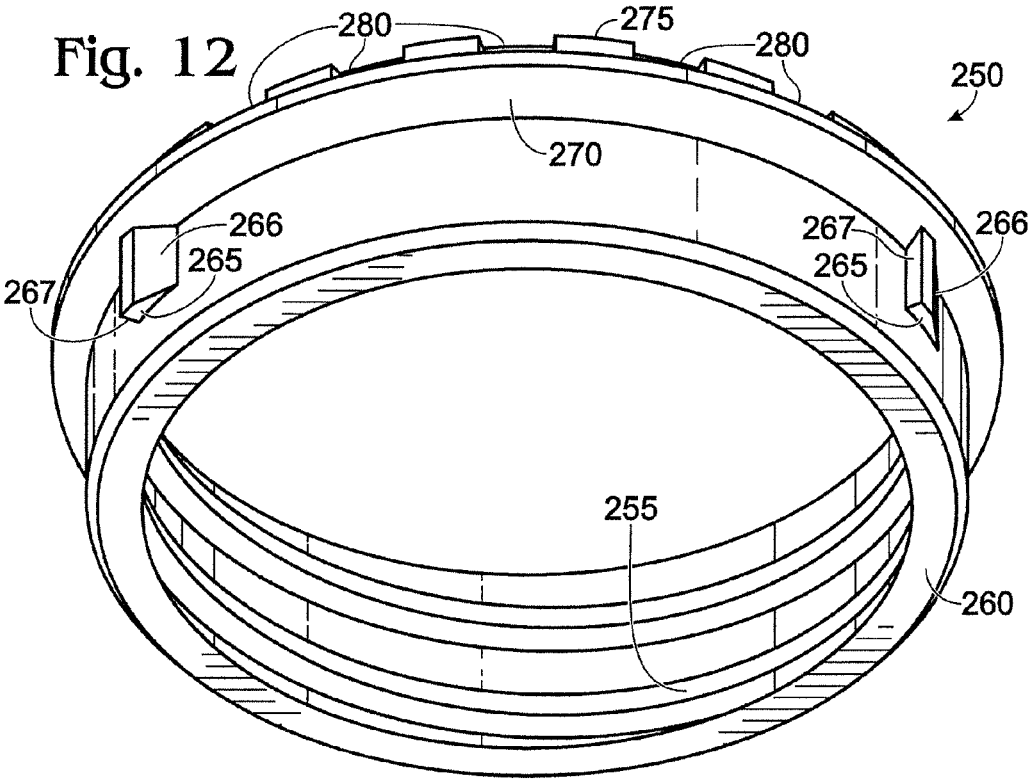
FIG. 12 is a view of an insert that is usable with the closure of FIGS. 7-11, in accordance with various embodiments.

The base 115 includes a generally circular-disc shape top deck 160 that may, in some embodiments, be gently convexly curved. A generally cylindrical outer skirt 165 depends from the periphery of the deck 160. A cylindrical inner skirt 170 depends from the deck 160 radially inwardly of the outer skirt 165 (FIGS. 10-12). At the open end of the skirt 170 a discontinuous annular snap bead 175 is positioned (FIGS. 10 and 11). A sealing spigot 185 depends from the deck 160 radially inwardly of the skirt 170 (FIGS. 10 and 11).

At the centre of the deck 160 an annular spout 190 projects and defines a central dispensing orifice 191. Within the spout 190 a self-closing valve 192 is carried (FIG. 11).

Figure 8:
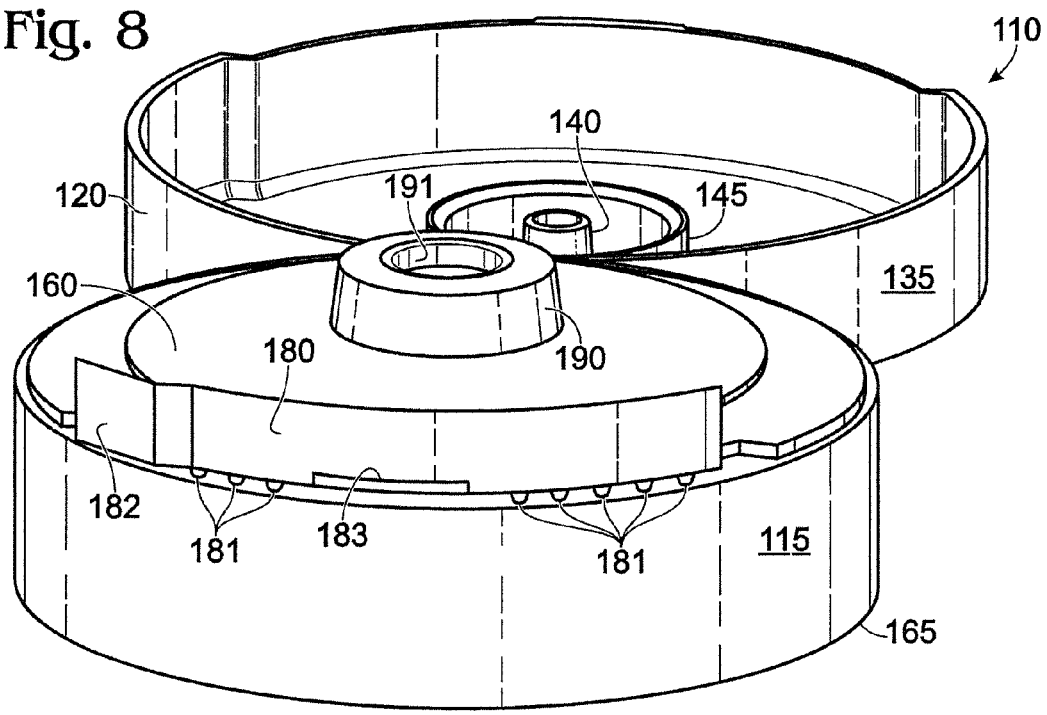
FIG. 8 is another top view of the closure of FIG. 7, in accordance with various embodiments.
Figure 9:
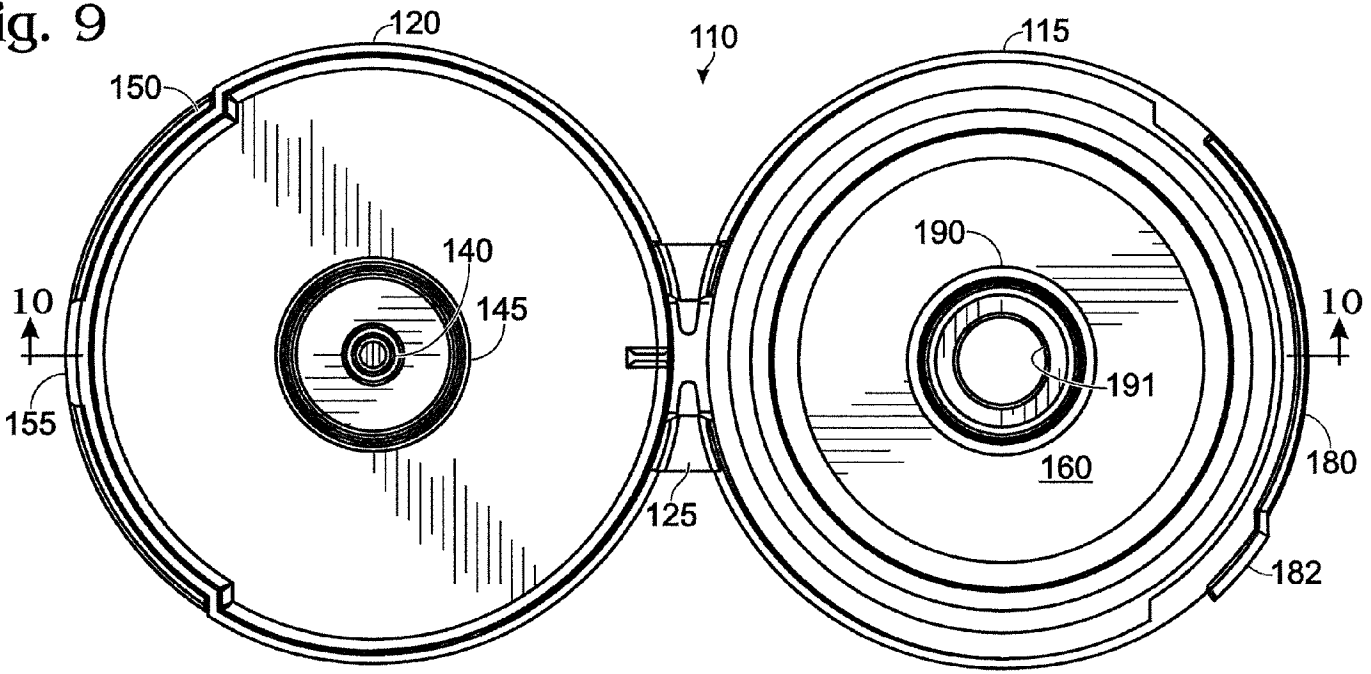
FIG. 9 is a top view of the closure of FIGS. 7 and 8, in accordance with various embodiments.

Opposite the hinge 125 an arcuate tamper-evident band 180 is connected to the deck 160 by a plurality of frangible bridges 181 (FIG. 8). At one end of the band 180 is a pull tab 182 that is not directly connected to the top deck 160. At the centre of the band a notch 183 is provided.

In FIGS. 7 to 13 the closure 110 is shown in an as-molded condition. Following molding the lid 120 is folded over onto the base. In doing so, the projection 145 fits around the spout 190 and the hook 155 passes behind the band 180 and snaps into the notch 183.

In use the lid 120 cannot be lifted away from the base 115 until the band 180 has been removed. To remove the band 180 the tab 182 may be grasped and pulled across the front of the closure, breaking the bridges 181 and allowing removal. Thereafter the lid 120 may be hinged away from the base 115 to expose the spout 190 so that product can be dispensed through the dispensing orifice 191 via the valve 192.

Figure 13:
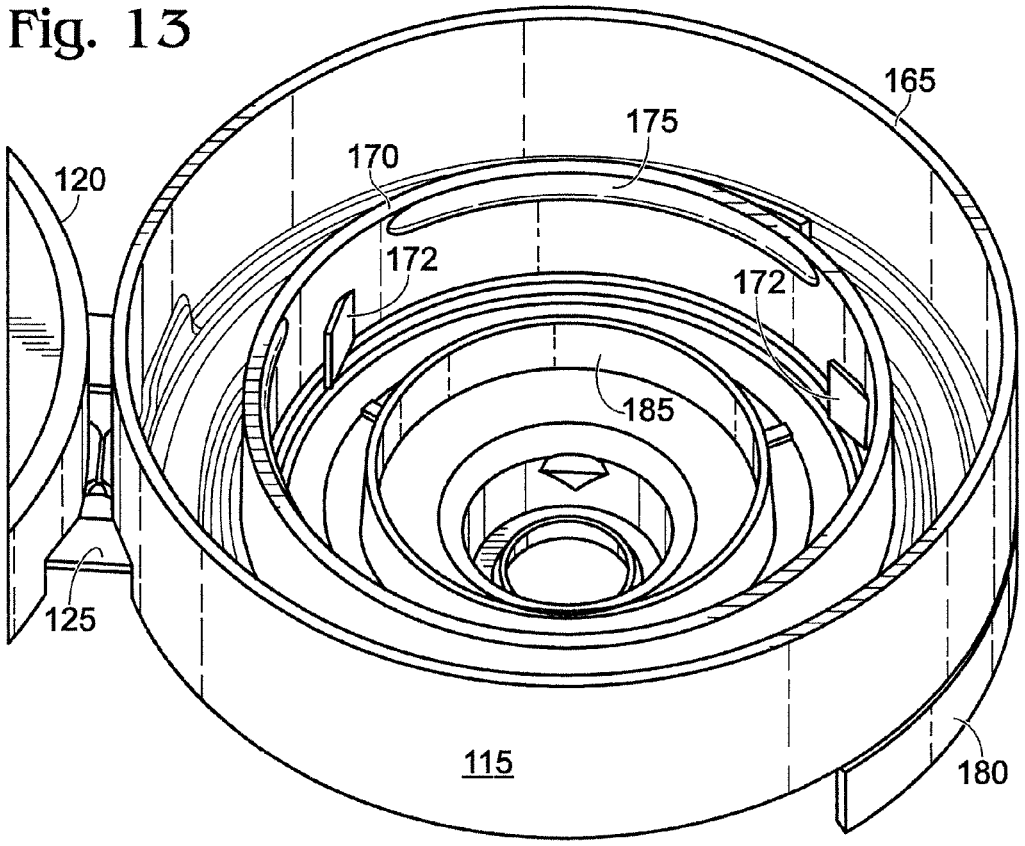
FIG. 13 is a partial view of the underside of the closure shown in FIGS. 7-11, with the insert shown in 12 removed, in accordance with various embodiments.

In FIGS. 11 and 13 the underside of the base 115 is shown. In FIG. 11, the inner skirt 170 carries within it an engagement insert 250 that is shown in more detail in FIG. 12. The engagement insert 250 has been removed in FIG. 13. In some embodiments, the inner skirt 170 may include one or more axial notches 171 (FIG. 11) which define lines of weakness that break if removal of the closure 110 from a neck is attempted.

Referring now to FIG. 12 the engagement insert 250 is shown in more detail. The engagement insert 250 may include a generally annular, collar-like body on the inside of which is provided a screwthread formation 255 for engaging a corresponding screwthread formation (not shown) on an associated container neck. The engagement insert 250 may include a top, engagement portion 260. A plurality of wedge-like teeth 265 may be provided around the periphery of the portion 260, each comprising an inclined face 266 and a flat abutment face 267. In some embodiments, there may be three teeth 265 distributed evenly (e.g., every 120 degrees) or unevenly around the periphery. In other embodiments, there may be other numbers of teeth 256 distributed evenly or unevenly about the periphery. In some embodiments, one or more teeth 265 may be omitted from what would otherwise be a plurality of evenly distributed teeth 265, e.g., to improve capping performance. A flange 270 may project radially outwardly from the portion 260. On the other side of the flange 270 a second portion 275 may extend and carry a plurality of notches 280.

In use, an engagement insert 250 of the type described in relation to FIG. 12 may be inserted into a closure 10, 110 of the type described in relation to FIGS. 1-11 and 13-16. The engagement insert 250 may be received with the first portion 260 orientated towards the top deck 60, 160 and may be push fitted so that the flange 270 engages under the snap members 74 or snap bead 175 so that the insert is firmly retained. With the engagement insert 250 in place the closure can be screwed onto a container neck. When the closure is applied to a container neck and rotated the base 15, 115 will rotate relative to the insert until the base lugs 172 contact respective abutment faces 267 of the insert teeth 265. At this point, continued rotation of the base may cause the insert, and hence the closure, to be screwed onto the container neck. Thereafter, if unscrewing of the closure is attempted, the base 15, 115 may rotate relative to the engagement insert 250 and the lugs 172 will pass over, but not engage the inclined faces 266 of the teeth. In other words relative rotation between the base and the insert may be permitted in the direction of unscrewing of the insert so that unscrewing cannot occur.

Figure 14:
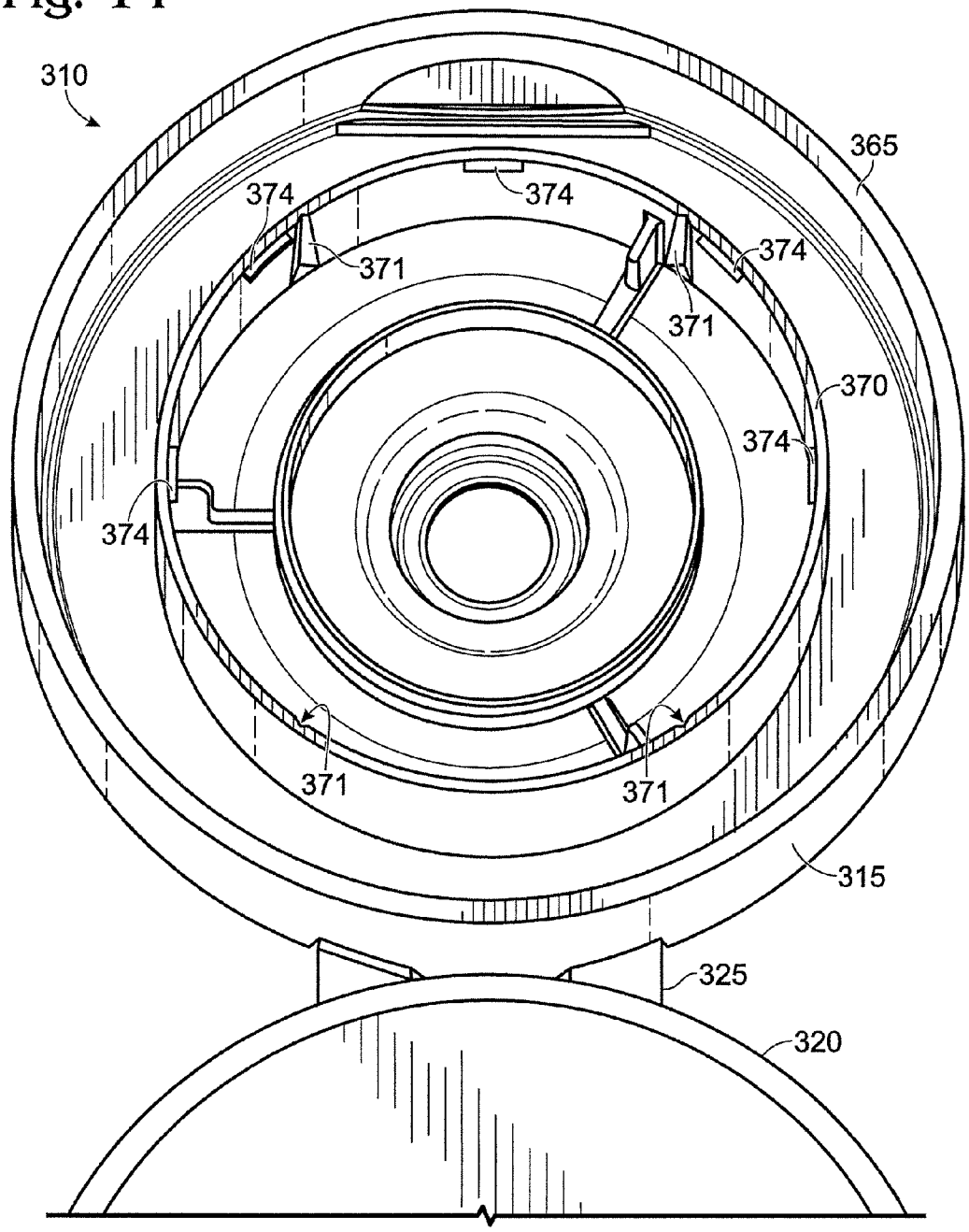
FIG. 14 is a partial view of another example closure in accordance with various embodiments.

FIG. 14 depicts another embodiment of a closure 310, similar to those described above. As before, closure 310 includes a base 315 and a lid 320 hingedly attached by a hinge 325. Closure 310 also includes a top deck (not visible), an outer skirt 365 that depends from the top deck, and an inner skirt 370 that also depends from the top deck. Like the closure 10 shown in FIGS. 2-6, closure 310 includes snap members 374.

Inner skirt 370 may include one or more regions of weakness adapted to break and/or deform upon an attempt to remove the closure 310 from the container neck, wherein after the break and/or deformation, the inner skirt 370 is no longer engageable with the container neck. In various embodiments, the regions of weakness may extend generally longitudinally along the inner skirt 370. In various embodiments, each region of weakness may be an axial notch 371 configured to tear upon the attempt to remove the closure 310 from the container neck.

Figure 15:
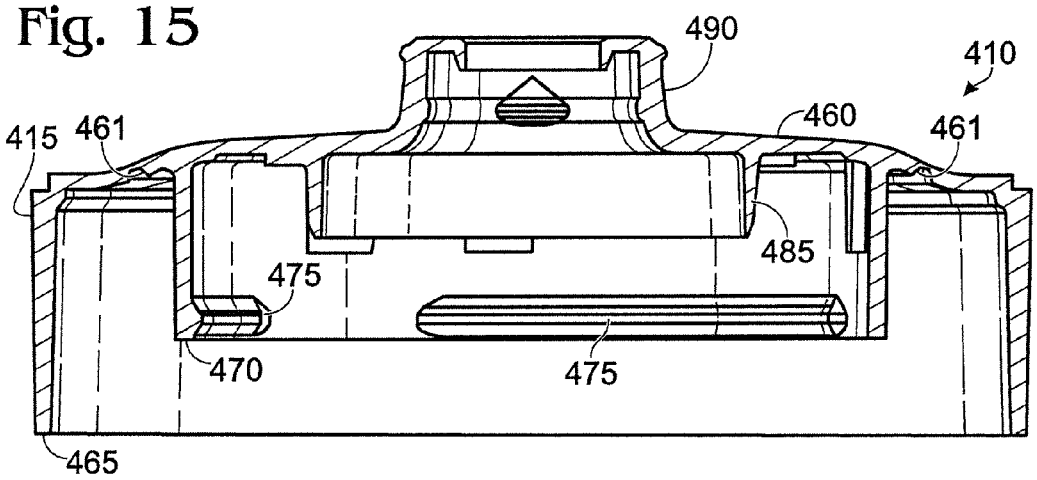
FIG. 15 depicts a cross-sectional view of another example of a closure in accordance with various embodiments.
Figure 16:
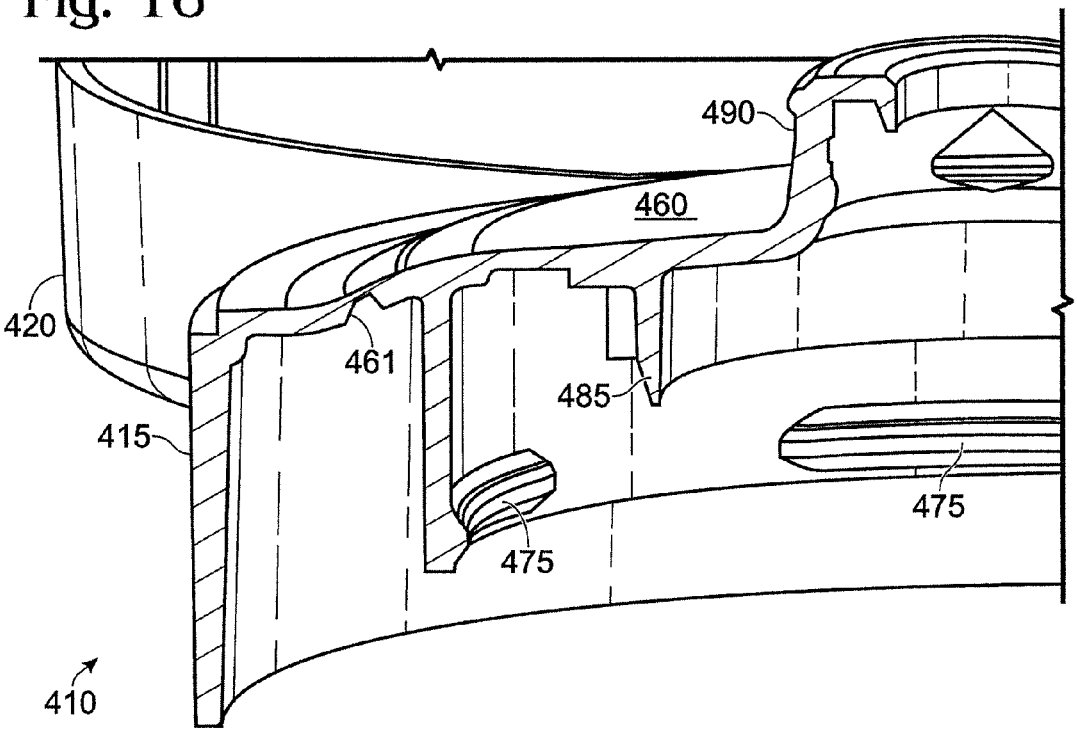
FIG. 16 depicts another cross-sectional view of the example closure of FIG. 15, in accordance with various embodiments.

Referring now to FIGS. 15 and 16, a base 415 formed according to an alternative embodiment is shown. The base 415 is very similar to the bases 15 and 315 shown in FIGS. 1 to 14 except there is no region of weakness on the inner skirt 470. Instead, the top deck 460 may include, between the inner skirt 470 and outer skirt 465, a region of weakness in the form of an annular notch 461 that provides a material thinning In some embodiments, annular notch 461 may be concentric with one or both of inner skirt 470 and outer skirt 465 Annular notch 461 may be present to cause deformation and/or breakage of the top deck 460 if an attempt is made to remove the closure following application to a container neck. In some embodiments, such as the one depicted in FIGS. 15 and 16, annular notch 461 is offset slightly from inner skirt 470.

If an attempt is made to pull or lever the closure off a container neck because it cannot be unscrewed, one or more of the regions of weakness described in relation to FIGS. 2-21 may be used to deliberately damage the closure so that it cannot be reapplied.

Figure 17:
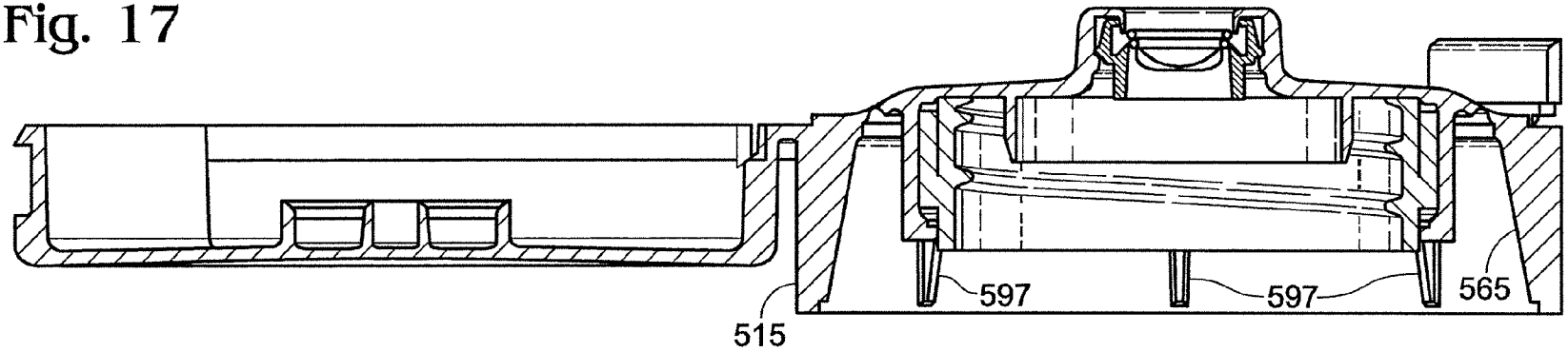
FIG. 17 depicts a cross-sectional view of another example of a closure in accordance with various embodiments.
Figure 18:
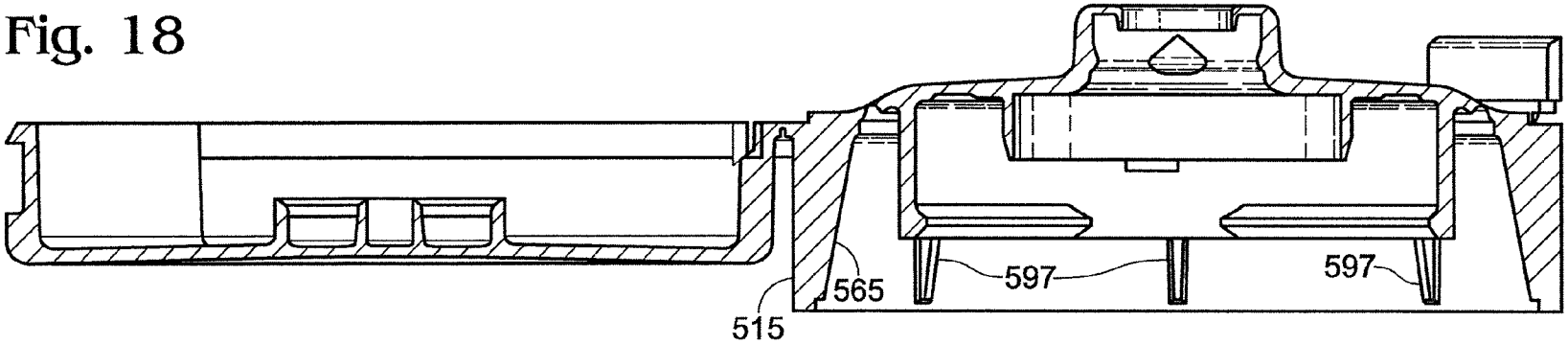
FIG. 18 depicts the example disclosure of FIG. 17, without a portion of a bottle inserted, in accordance with various embodiment.

Referring now to FIGS. 17 and 18, a base 515 formed according to an alternative embodiment is shown. The base 515 may be similar to the bases 15, 315 and 415 shown in previous figures except that it includes, on an inner surface of its outer skirt 565, a plurality of ribs 597. The ribs 597 may reinforce the outer skirt 565 so that it is less pliable.

Figure 19:
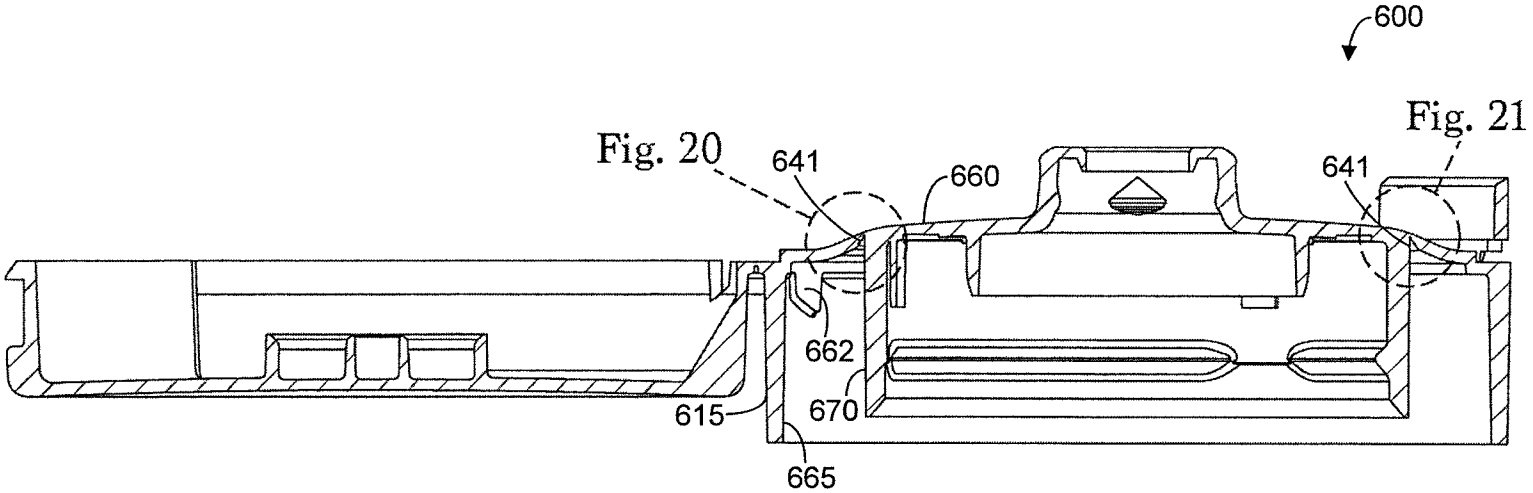
FIG. 19 depicts a cross-sectional view of another example of a closure in accordance with various embodiments.

Referring now to FIG. 19, an alternative embodiment of a closure 600 may include a base 615 that may be similar to the bases 15, 315, 415 and 515 shown in previous figures in many respects. However, a top deck 660 may include a region of weakness in the form of an annular notch 661 that provides a material thinning Similar to annular notch 461 of FIGS. 15 and 16, annular notch 661 may be concentric with one or both of inner skirt 670 and outer skirt 665, and may be present to cause deformation and/or breakage of the top deck 660 if an attempt is made to remove the closure following application to a container neck. Unlike the embodiments shown in FIGS. 15 and 16, however, and as best shown in FIGS. 20 and 21, annular notch 661 may be formed at or near a junction between inner skirt 670 and top deck 660.

Figure 21:
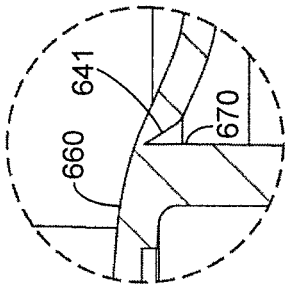
FIGS. 20 and 21 depict close up views of portions of the closure of FIG. 19, in accordance with various embodiments.
Figure 20:
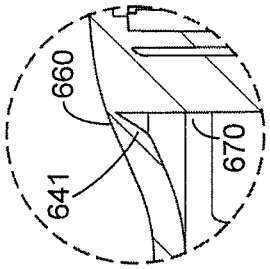

In various embodiments, such as those shown in FIGS. 19-21, one or more gussets 662 may be provided in between inner skirt 670 and outer skirt 665. Gussets 662 may reduce or eliminate "ovalization" of closure 600 that sometimes may occur during removal of closure 600 from a bottle or other container (not shown), e.g., by functioning as a structure to separate outer skirt 665 from inner skirt 670. While only a single gusset 662 is visible in FIG. 19, in various embodiments, closure 600 may include various numbers of gussets 662, such as eight, distributed evenly or unevenly about a circumference of base 615.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the appended claims.

What is claimed is:

1. A container, comprising:

a bottle with a neck;

a closure that is engageable with the neck of the bottle, the closure comprising:

an upper deck;

an outer skirt depending from the upper deck;

an inner skirt depending from the upper deck and being concentric with the outer skirt; and a region of weakness located on the inner skirt adapted to break and/or deform upon an attempt to remove the closure from the neck of the bottle, wherein after the break and/or deformation, the closure is no longer engageable with the neck of the bottle; and wherein the region of weakness extends generally longitudinally along the inner skirt and comprises an axial notch configured to tear upon the attempt to remove the closure from the container neck.

2. A container, comprising:

a bottle with a neck;

a closure that is engageable with the neck of the bottle, the closure comprising:

an upper deck;

an outer skirt depending from the upper deck;

an inner skirt depending from the upper deck and being concentric with the outer skirt; and a region of weakness adapted to break and/or deform upon an attempt to remove the closure from the neck of the bottle, wherein after the break and/or deformation, the closure is no longer engageable with the neck of the bottle; and wherein the region of weakness comprises an annular notch located on the top deck between the inner skirt and the outer skirt.

3. The container of claim 2, wherein the annular notch is offset from the inner skirt.

4. A container, comprising:

a bottle with a neck;

a closure that is engageable with the neck of the bottle, the closure comprising:

an upper deck;

an outer skirt depending from the upper deck;

an inner skirt depending from the upper deck and being concentric with the outer skirt; and a region of weakness adapted to break and/or deform upon an attempt to remove the closure from the neck of the bottle, wherein after the break and/or deformation, the closure is no longer engageable with the neck of the bottle, wherein the region of weakness comprises an annular notch located at a juncture between inner skirt and the top deck.

* * * * *